United States Patent [19]

Everett

[11] 4,164,901

[45] Aug. 21, 1979

[54] INDOOR GUN FIRING RANGE ENCLOSURE HAVING A VENTILATION SYSTEM

[75] Inventor: Robert W. Everett, Louisville, Ky.

[73] Assignee: American Air Filter Company, Inc., Louisville, Ky.

[21] Appl. No.: 869,834

[22] Filed: Jan. 16, 1978

[51] Int. Cl.[2] ..... F24F 13/00

[52] U.S. Cl. ..... 98/33 A; 98/36; 55/138; 89/1 E; 35/25; 273/102 R

[58] Field of Search ..... 273/102 R, 102.4; 272/3; 98/36, 115 SB, 40 D, 33 A; 35/25; 55/DIG. 29, DIG. 18, 385 A, 138; 118/326, 634, DIG. 7; 89/1 E

[56] References Cited

U.S. PATENT DOCUMENTS

| | | | |
|---|---|---|---|
| 2,827,266 | 3/1958 | Ruff | 98/36 |
| 2,990,912 | 7/1961 | Cole | 55/138 |
| 3,048,094 | 8/1962 | Bailey | 98/33 A |
| 3,068,775 | 12/1962 | Zehnder | 98/36 |
| 3,143,952 | 8/1964 | Simons | 98/33 A |
| 3,722,182 | 3/1973 | Gilbertson | 55/138 |
| 3,802,099 | 4/1974 | Mell et al. | 273/102 R |
| 3,988,131 | 10/1976 | Kanazawa et al. | 55/138 |
| 4,114,521 | 9/1978 | Busch | 98/36 |

*Primary Examiner*—Henry C. Yuen

*Attorney, Agent, or Firm*—Jon C. Winger

[57] ABSTRACT

An indoor gun firing range enclosure with a ventilation system for removing particulate matter, such as lead or other heavy metals, and unburned gunpowder, plus gaseous contaminants such as carbon monoxide, from the atmosphere within the enclosure to make the atmosphere within the enclosure safer for persons using the firing range.

In addition, a method of ventilating the indoor firing range enclosure for the same purpose.

Both the ventilation system and method of ventilating contemplate removing a portion of the air from within the enclosure and after removing particulate matter from this air, exhausting it to the out-of-doors. Concurrently, another portion of the air is removed from the interior of the enclosure for recirculation into the enclosure after particulate matter is removed from it. Out-of-doors air is also mixed with the recirculated portion of the air to make up for some of the air exhausted from the enclosure to the out-of-doors.

12 Claims, 6 Drawing Figures

INDOOR GUN FIRING RANGE ENCLOSURE HAVING A VENTILATION SYSTEM

BACKGROUND OF THE INVENTION

The present invention relates to ventilation systems and more particularly to a ventilation system for indoor gun firing range enclosures.

Various ventilation systems for enclosures are known. However, indoor gun firing range enclosures present particularly difficult problems to proper ventilation because of the types of particulate matter and gases which contaminate the enclosure atmosphere. For instance, when a gun is fired, the following chemical elements are released into the atmosphere: boron, sodium, aluminum, silicon, phosphorous, sulfur, chlorine, potassium, calcium, titanium, chromium, manganese, iron, nickel, copper, zinc, arsenic, selenium, silver, cadmium, tin, antimony, telrium, mercury, thallium, bismuth and lead as well as unburned gunpowder and carbon monoxide gas. The concentration of these contaminants must not be allowed to build up in the atmosphere of the enclosure least they do injury to the users of the indoor gun firing range. Likewise, of course, these contaminants cannot be released into the out-of-doors.

In addition to preventing the level of concentration of these contaminants from building up, it is also important to prevent the contaminants from reaching the persons using the indoor firing range even before the concentration reaches a dangerous level.

SUMMARY OF THE INVENTION

The present invention recognizes these considerations and problems and presents a solution which is not only effective but which can be installed in existing indoor gun firing range enclosures as well as being designed into firing range enclosures to be built.

More particularly, the present invention provides an indoor gun firing range comprising:

An indoor gun firing range comprising:

an enclosure having an uprange end wall, a downrange end wall spaced from and generally parallel to the uprange end wall, two spaced apart side walls interconnecting the uprange end wall and downrange end wall, and a ceiling;

gun shooting positions located a distance from the uprange end wall;

a bullet trap located proximate the downrange end wall;

an air exhaust system for removing a portion of the air from the interior of the enclosure, cleaning the air so removed and exhausting the cleaned air to the out-of-doors comprising duct means having an inlet open to the interior of the enclosure disposed in the ceiling of the enclosure at a location downrange from the gun shooting position; particulate matter separator means in communication with the duct means downstream of the inlet to the duct for separating particulate matter from the air being conveyed in the duct means for causing a flow of air from the interior of the enclosure through the duct means; and, an outlet from the duct means open to the out-of-doors;

an air recirculation system for removing the portion of air from the interior of the enclosure not removed by the air exhaust system and re-introducing back into the interior of the enclosure, comprising duct means having an inlet open to the interior of the enclosure proximate the downrange end of the enclosure; particulate matter separation means in communication with the duct means downstream of the inlet to the duct means for separating particulate matter from the air being conveyed in the duct means; air moving means in communication with the duct means for causing a flow of air from the interior of the enclosure through the duct means; and, an outlet from the duct means open to the interior of the enclosure proximate the uprange wall of the enclosure; and, an out-of-doors air make up system in gaseous communication with the duct means of the air recirculation system for replacing at least a portion of the air removed from the interior of the enclosure by the air exhaust system with out-of-doors air.

In addition, the present invention also provides a method of ventilating an indoor firing range enclosure which comprises:

a method of ventilating an indoor gun firing range enclosure, which comprises:

continuously removing approximately 30% of the air from the enclosure at a location downrange of persons using the firing range;

removing particulate matter from this removed 30% of the air;

exhausting this removed 30% of the air to the out-of-doors;

continuously removing approximately 75% of the air from the enclosure at a location proximate the target area at which the persons using the range are shooting;

removing particulate matter from this removed 75% of the air;

removing particulate matter from a volume of out-of-doors air substantially equal to 25% of the air in the enclosure;

adding the out-of-doors air equal to 25% of the air in the enclosure to the removed 75% of the air;

introducing the mixture of out-of-doors air equal to 25% of the air in the enclosure and removed 75% of the air into the enclosure at a location uprange of persons using the firing range; and, moving the introduced mixture of out-of-doors air equal to 25% of the air in the enclosure and removed 75% of the air past the persons using the firing range in a downstream direction at a substantially uniform velocity of approximately 75 (plus or minus 8%) feet per minute per every square foot of cross-sectional area across the entire width and height of the enclosure.

BRIEF DESCRIPTION OF THE DRAWINGS

A better understanding of the present invention will be had upon reference to the accompanying drawings wherein like numerals refer to like parts throughout and in which.

DETAILED DESCRIPTION OF THE PREFERRED EMBODIMENT

Figure 1:
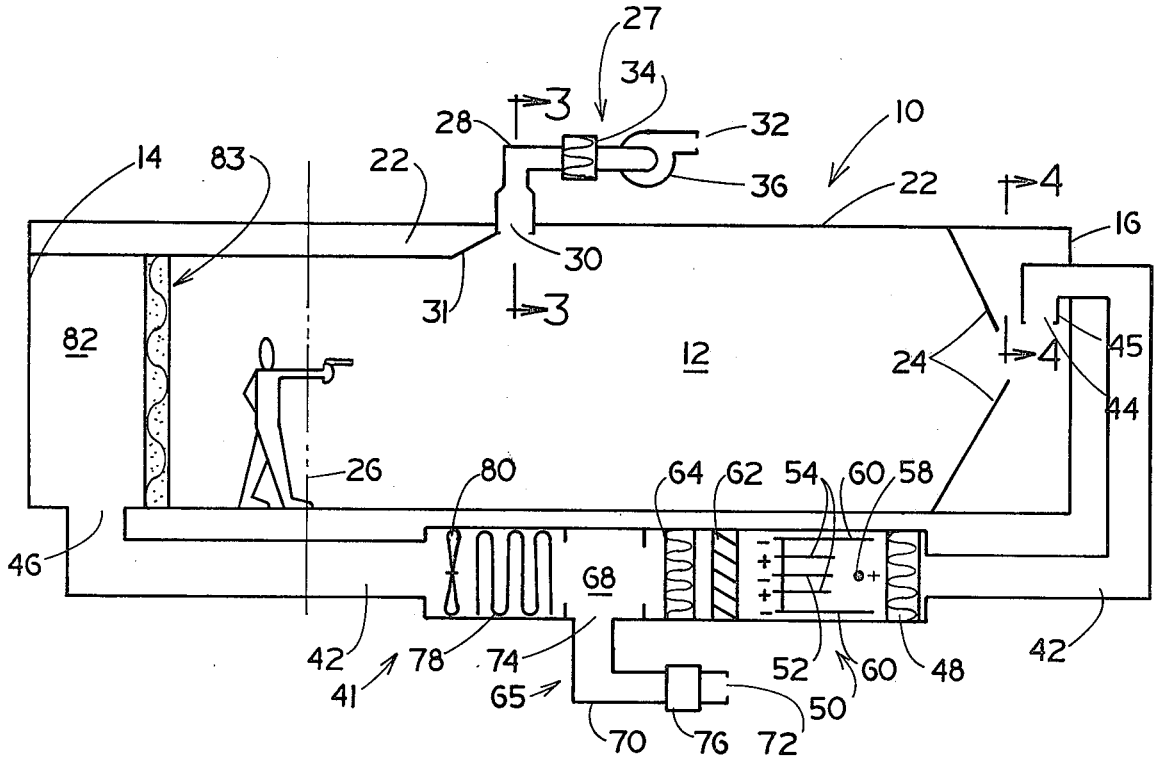
FIG. 1 is an elevational side view schematic representation of an indoor gun firing range enclosure of the present invention.
Figure 2:
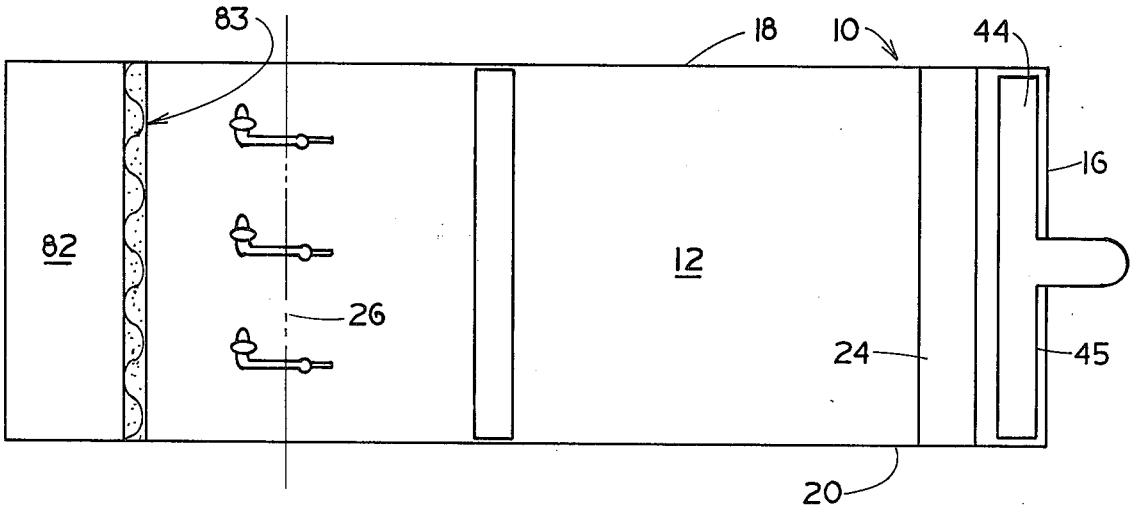
FIG. 2 is a plan view of the schematic representation of the indoor gun firing range enclosure of the present invention.

Referring first to FIGS. 1 and 2, there is illustrated an indoor gun firing range, generally denoted as the numeral 10, which comprises an enclosure 12 having an uprange end wall 14, a downrange end wall 16 spaced from and parallel to the uprange end wall 14, two spaced apart side walls 18 and 20 interconnecting uprange and downrange end walls 14 and 16 and a ceiling 22 over the tops of the walls.

The terms uprange and downrange as used herein define the positions of the end walls and other components of the invention relative to the individual using the gun firing range. The term "uprange" refers to a location in back of the shooter or direction opposite to the direction in which the user of the range is shooting. The term "downrange" refers to a location in front of the shooter or in the direction in which the user of the range is shooting.

Typical of indoor gun firing ranges, the range 10 also has a bullet trap or bullet butt 24 located at the downrange wall 16 to capture the bullet slugs, and a shooter's position or firing line 26 located a distance from the uprange wall 14 whereat the shooter's position themselves for firing their weapons at targets (not shown) located in front of or uprange of the bullet trap 24.

Figure 3:
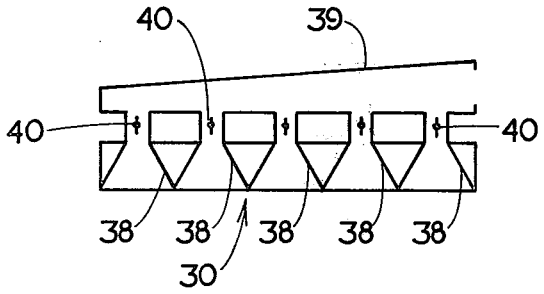
FIG. 3 is a transverse cross-sectional view taken in the direction of arrows 3—3 in FIG. 1.

The enclosure 12 has an air exhaust system 27 for removing and cleaning a portion of the air from within the enclosure and exhausting it to the out-of-doors. The exhaust system is open as at numeral 30 to the interior of the enclosure 12 at the ceiling 22 at a location downrange from the gun shooter's position 26, i.e., between the gun shooter's position 26 and the downrange end wall 16, and is open as at the numeral 32 to the out-of-doors. The exhaust system 27 includes a duct 28, a particulate matter separator means 34, such as a dry-type filter, situated in the air stream passing through the exhaust duct 28 for separating particulate matter from the air stream, and a gas moving means 36, such as a fan located in the duct 28 to initiate and maintain a flow of air from the interior of the enclosure 12 through the exhaust system. The fan 36 and other components of the exhaust system are preferably sized to continuously exhaust approximately 30% by volume of the air within the enclosure with an entrance velocity through the inlet 30 into the exhaust system of approximately 600 feet per minute. The inlet 30 should extend transversely across the enclosure 12 from side wall 18 to side wall 20. The inlet 30 can be comprised of a plurality of individual hoods 38 disposed in side-by-side juxtaposition and communicating with a single manifold 39 as shown in FIG. 3, or be a single continuous hood (not shown). Individual interconnected hoods 38 each equipped with a damper 40 are preferable for the reason that the air flow through the system can be more readily balanced to achieve a uniform air flow velocity across the width of the enclosure than with only one hood.

Figure 4:
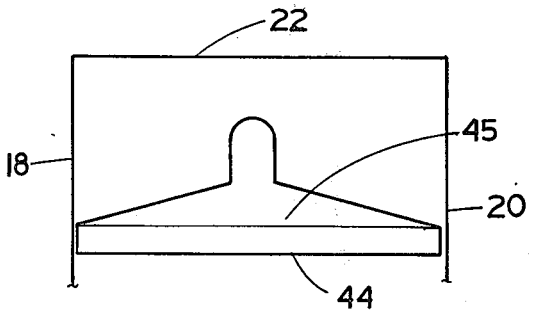
FIG. 4 is a transverse cross-sectional view taken in the direction of arrows 4—4 in FIG. 1.

The enclosure 12 also has an air recirculation system 41 for removing the portion of air from the interior of the enclosure not removed by the air exhaust system and re-introducing it back into the interior of the enclosure after it has been cleaned of particulate matter and otherwise processed to dilute harmful gases it may contain. The recirculation system comprises a recirculation duct 42 having an inlet 44 open to the interior of the enclosure 12 proximate the downrange end wall 16, and an outlet 46 also open to the interior of the enclosure 12 proximate the upstream end wall 14. The inlet 44 is defined by an exhaust hood 45 (see FIG. 4) and extends substantially the entire width of the enclosure. The recirculation system further includes a particulate matter separator means 48, such as an automatic viscous impingement type filter, situated in the air stream passing through the recirculation duct 42 for separating matter, such as large particles of unburned gunpowder, particles of lead and particles of paper from the targes, from the air stream. Immediately downstream from the filter 48 is another particulate matter separator 50 also located in the air stream flowing in the recirculation duct 42. This particulate matter separator 50 is an electrostatic precipitator having parallel disposed alternately grounded collecting plates 52 and positively charged collecting plates 54 oriented parallel to the direction of air flow and an ionizer located upstream of the collecting plates and consisting of at least one positively charged wire 58 located between two grounded plates 60. The collecting plates 52 and 54 are coated with a viscuous adhesive coating, such as tricresyl phosphate. The air-borne particulate matter, not removed by the filter 48, passing through the ionizer past the charged wire 48 is electrically charged. The now charged air-borne particulate matter passes through the collecting plates 52 and 54 downstream of the ionizer and is repelled by the collecting plates of the same polarity and attracted by the collecting plates of opposite polarity. The tricresyl phosphate serves to adhesively capture the particulate matter attracted to the collector plates and at the same time helps to eliminate the fire hazard created by the unburned gunpowder being collected on the collector plates 52, 54, and pitting of the plates by arching of lead particulates. Next in sequence in the recirculation system, also located in the gas stream flowing in the recirculation duct 42 is a damper assembly 62 which is used to selectively allow and prevent continued air flow through the recirculation duct 42. It may be desirable from time to time to stop the flow of air through the recirculation duct and isolate the electrostatic precipitator from other components of the system located downstream of the electrostatic precipitator, such as when cleaning the collected particulate matter from the collecting plates 52, 54. In this event, the damper assembly is closed to prevent moisture and dirt from being washed downstream. Following the damper assembly in the recirculation system is another particulate matter separator 64, such as a high efficiency particulate matter dry-type filter which is also located in the air stream flowing through the recirculation duct 42. Obviously, the electrostatic precipitator is not 100% efficient in capturing all of the particulate matter passing through it. In addition, as the particulate matter agglomerates on the collecting plates 52, 54, some could slough off to be recaptured in the air stream. The high efficiency particulate matter filter 64 is used to remove the particulate matter not captured by the electrostatic precipitator or sloughed off the electrostatic precipitator. In addition to the particulate matter released upon the firing of a gun, there are also harmful gases which are produced, such as carbon monoxide, carbon dioxide, barium oxide, nitrogen dioxide, nitrogen tetraoxide and oxides of sulfur. In order to render these gases harmless, and also to supply air to make up for the air removed from the enclosure by the air exhaust system, an out-of-doors air make up system 65 is provided in gaseous communication with the recirculation system 41. The out-of-doors air make up system comprises an air mixing box 68 in gaseous communication with the recirculation duct 42 so that the air stream flowing in the recirculation duct 42 must pass into the air mixing box 68 after it leaves the particulate matter separator 64. The out-of-doors air make up system further comprises an out-of-doors air duct 70 which is open at one end 72 to the out-of-doors and open at the other end 74 to the interior of the mixing box 68. A particulate matter separator device, such as an automatic cleanable viscous impingement filter, is disposed within the out-of-doors air duct 70 to separate particulate matter from the out-of-doors air stream flowing in the duct 70 toward the mixing box 68. The amount of out-of-doors air taken in by the out-of-doors make up air system is approximately equal to 25% by volume of the supply air volume. The exhaust air is approximately 30%. Thus, because more air is being removed from the enclosure by the exhaust system 27 than is being resupplied by the out-of-doors air make-up system 65, the enclosure is maintained at a slight negative air pressure relative to the ambient. Air being recirculated by the recirculation air system 41 thoroughly mixes with the out-of-doors make-up air brought in by the make-up air system 65 in the mixing box 68 thereby diluting the concentration of harmful gases which may be borne by the air being recirculated in the recirculation system.

Heating and cooling means 78 can be located in the recirculation duct 42 downstream of the mixing box 68 to selectively heat or cool the now mixed air flowing in the recirculation duct 42 from the mixing box 68. The heating and cooling means can be virtually any conventional or otherwise convenient system. The heating and cooling means will not be further discussed for the reason that it does not form a part of the invention.

Air moving means, such as a fan or blower 80, is disposed within the recirculation duct 42 for moving the air from the enclosure 12 into the recirculation system 41, from the out-of-doors air into the make-up air system 65, and moving the mixture of recirculated air from the enclosure and out-of-doors make up air through the recirculation duct 42 back to the enclosure through the recirculation air system outlet 46.

The recirculation system 41 also comprises a plenum chamber 82 proximate the upstream end of the enclosure 12 which is constructed and configured to direct at least a portion of the mixture of recirculated air and out-of-doors make up air in a horizontal direction toward the downstream end wall 16. FIG. 1 illustrates one advantageous embodiment of the recirculation air plenum chamber 82 which comprises an air pervious diffusing wall 83 spaced from the uprange end wall 14 and extends substantially the height and width of the enclosure. The recirculation system outlet 46 communicates with the plenum chamber so as to discharge the mixture of recirculated air and out-of-doors air into the plenum chamber 82. Air entering the plenum chamber 82 is evenly distributed over the width and height of the plenum chamber 82 and subsequently flows out of the plenum chamber through the air previous diffusing wall 83 in a substantially horizontal direction toward the shooting positions 26. The various components of the recirculation system 41 are sized to provide a substantial uniform air velocity of 75 feet per minute (plus or minus 8%) at the firing positions 26 across the width and height of the enclosure.

Figure 5:
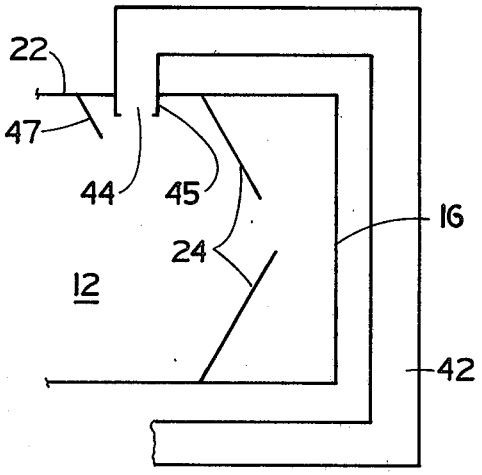
FIG. 5 illustrates another advantageous position of a component of the present invention.

FIGS. 1 and 2 illustrate one advantageous location for the exhaust hood 45, and thus the inlet 44 into the air recirculation system 41. This location is in back of, or between the butts 24 and down range end wall 16 of the enclosure. This position for the hood 45 protects it from being damaged by bullets as well as locating it in an area whereat it can conveniently pick up lead particles from the bullets hitting the butts 24 and paper fragments from the targets. An alternative location for the hood 45 is shown in FIG. 5 which illustrates the hood positioned uprange of, or in front of the butts 24 at the ceiling 22. When the hood 45 is located in front of the butts 24 a bullet guard 47 must be provided to protect the hood from being damaged by bullets. The various components of the air recirculation system are preferably sized and configured to continuously move approximately 75% by volume of the air within the enclosure with an entrance velocity through the inlet opening 44 into the exhaust hood 45 of approximately 600 feet per minute.

Figure 6:
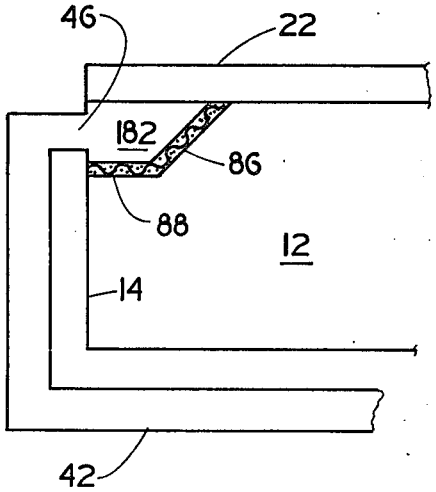
FIG. 6 illustrates another advantageous embodiment of a component of the present invention.

FIG. 6 illustrates another embodiment of the the plenum chamber, in this instance denoted by the numeral 182, which is disposed in the corner of the room defined by the ceiling 22 and the uprange end wall 14 and extends substantially the width of the enclosure from the side wall 18 to the side wall 20. The plenum chamber 182 is comprised of two air pervious diffusing walls 86 and 88 providing for the egress of air from the plenum chamber 182. The one air pervious wall 86 is oriented at a 45° angle to the vertical and the other air pervious wall 88 is horizontally oriented. The two air pervious walls 86 and 88 are adjacent each other. The recirculation air duct 42 discharges the mixture of recirculated air and out-of-doors make up air into the plenum chamber 182. A portion of the air flows out of the plenum chamber 182 through the air pervious plenum wall 86 at an angle of approximately 45° to the vertical and the remaining portion flows out of the plenum chamber 182 through the other air pervious wall 88 in a downwardly direction. The two portions of the air flowing from the plenum chamber 182 are, subsequently, caused to turn to a horizontal flow direction under the influence of the exhaust system 27 and recirculation air system 41 so that the air flow from the plenum chamber 182 is horizontal when it reaches the firing positions 26. This embodiment is particularly useful in those instances where the air recirculation system is to be installed in an existing indoor gun firing enclosure where installation of the wall plenum chamber 82 may be prohibitively expensive.

At least that portion of the ceiling 22 which extends from the plenum chamber 82, 182 to a location downrange of the shooting positions 26 is preferably spaced from 8 feet to 8½ feet above the floor of the enclosure. If the exhaust, recirculation, and out-of-doors air make-up systems of the present invention are to be installed in an existing enclosure having a roof or ceiling greater than 8½ feet then it will be necessary to install a false or dropped ceiling 22. Preferably, as can be seen in FIG. 1, the inlet 30 to the exhaust duct 28 is above the horizontal plane of the ceiling 22, for example, approximately 6 inches above the horizontal plane of the ceiling. Thus, if the ceiling is 8 feet above the enclosure floor, the inlet 30 to the exhaust duct 28 would be 8½ feet above the enclosure floor and if the ceiling is 8½ feet above the the inlet 30 to the exhaust duct 28 would be 9 feet above the enclosure floor. To provide a smooth transition for the flow of air from the enclosure into the inlet 30 to the exhaust duct 28, the ceiling 22, in an area proximate the inlet 30, is sloped upwardly as indicated by the numeral 31 to the margin of the inlet 30. In practice, it has been found that a slope of 6 inches vertically over a horizontal distance of 2½ feet works well.

As a shooter fires a gun pointed toward the targets located at the downrange wall 16 in front of the bullet trap 24, the horizontal flow of air from the outlet 46 from the recirculation system sweeps past the shooter in an even flow carrying the products produced by the firing of the gun away from the shooter in a downrange direction so that the shooter will not breathe these products nor be otherwise exposed to them. As these products are carried downrange of the shooter by the horizontal flow of air from the plenum chamber 82, 182 of the recirculation system, approximately 30% of the supply volume containing approximately 80% of the products produced by the firing of the gun passes through the inlet 30 to the exhaust duct 28 under the influence of the fan 36 in the exhaust system to be exhausted to the out-of-doors after it is filtered. The remaining portion of these products are carried further downrange by the horizontal flow of air from the plenum chamber 82, 182 of the recirculation system toward and through the inlet 44 into the recirculation duct 42 under the influence of the blower 80 in the recirculation system to be recirculated back into the enclosure through the plenum chamber 82, 182 after it has been filtered, and diluted by out-of-doors air passing into the recirculation system from the out-of-doors air make up system.

The foregoing detailed description is given primarily for clarity of understanding and no unnecessary limitations should be understood therefrom, for modifications will be obvious to those skilled in the art upon reading this disclosure and may be made without departing from the spirit of the invention or the scope of the appended claims.

What is claimed is:

1. An indoor gun firing range comprising:

an enclosure having an uprange end wall, a downrange end wall spaced from and generally parallel to the uprange end wall, two spaced apart side walls interconnecting the uprange end wall and downrange end wall, and a ceiling;

gun shooting positions located a distance from the uprange end wall;

a bullet trap located proximate the downrange end wall;

an air exhaust system for removing a portion of the air from the interior of the enclosure, cleaning the air so removed and exhausting the cleaned air to the out-of-doors comprising duct means having an inlet means open to the interior of the enclosure disposed at the ceiling of the enclosure at a location downrange from the gun shooting position for removing air from the enclosure; particulate matter separator means in communication with the duct means downstream of the inlet to the duct for separating particulate matter from the air being conveyed in the duct means from the enclosure; air moving means in communication with the duct means for causing a flow of air from the interior of the enclosure through the duct means; and, an outlet means from the duct means for releasing the air to the out-of-doors;

an air recirculation system for removing that portion of air from the interior of the enclosure not removed by the air exhaust system and re-introducing back into the interior of the enclosure, comprising duct means having inlet means open to the interior of the enclosure proximate the downrange end of the enclosure for removing air from the enclosure; particulate matter separation means in communication with the duct means downstream of the inlet means to the duct means for separating particulate matter from the air being conveyed in the duct means; air moving means in communication with the duct means for causing a flow of air from the interior of the enclosure through the duct means; and, an outlet means from the duct means open to the interior of the enclosure proximate the uprange wall of the enclosure for discharging air back into the enclosure; and, an out-of-doors air make-up system in gaseous communication with the duct means of the air recirculation system for replacing at least a portion of the air removed from the interior of the enclosure by the air exhaust system with out-of-doors air.

2. The indoor gun firing range of claim 1 wherein:

the air exhaust system continuously removes approximately 30% of the air from the interior of the enclosure; and, the out-of-doors make-up air system continuously replaces 25% of the air back into the interior of the enclosure, thus, resulting in a negative air pressure within the interior of the enclosure.

3. The indoor gun firing range of claim 1 wherein the velocity of the air is emitted from the air recirculation system in a generally horizontal flow at the gun firing positions with a velocity measured at the gun firing positions of a substantially uniform 75 feet per minute per square foot of cross-sectional area across the width and height of the enclosure.

4. The indoor gun firing range of claim 1 wherein the air recirculation system further comprises:

an air mixing box in gaseous communication with out-of-doors air intake system and with the duct means of the air recirculation system for thoroughly mixing the recirculated air with the out-of-doors make-up air.

5. The indoor gun firing range of claim 4 wherein the air recirculation system further comprises air heating and cooling means located downstream of the mixing box for temperature conditioning the mixture of recirculated air and out-of-doors make-up air before it is discharged to the interior of the enclosure.

6. The indoor gun firing range of claim 1 wherein the particulate matter separating means comprises an electrostatic precipitator separator device having electrode plates upon which are collected particles of lead and unburned gunpowder, and having the electrode plates coated with an oil which prevents ignition of the unburned gunpowder and arching of the particles of lead collected on the electrode plates.

7. The indoor gun firing range of claim 1 wherein the outlet means from the air recirculation system comprises a plenum chamber with an air pervious wall disposed to direct at least a portion of the mixture of recirculated air in a horizontal direction toward the downrange end wall of the enclosure.

8. The indoor gun firing range of claim 1 wherein:

the inlet means to the air exhaust air system extends substantially across the entire width of the interior of the enclosure.

9. The indoor gun firing range of claim 1 wherein:

air is drawn through the inlet means into the air exhaust system at a substantially uniform velocity of 600 feet per minute across the width of the enclosure; and, air is drawn through the inlet means into the air recirculation system at a substantially uniform velocity of 600 feet per minute across the width of the enclosure.

10. The indoor gun firing range of claim 1 wherein:

the inlet means into the air exhaust system is located above the horizontal plane of the ceiling of the enclosure; and, a portion of the ceiling of the enclosure uprange of and adjacent to the inlet means to the air exhaust system is inclined from the horizontal plane of the ceiling of the enclosure to the inlet means into the air exhaust system.

11. A method of ventilating air indoor gun firing range enclosure, which comprises:

continuously removing approximately 30% of the supply air from the enclosure at a location downrange of persons using the firing range;

removing particulate matter from this removed 30% of the air;

exhausting this removed 30% of the supply air to the out-of-doors;

continuously removing approximately 75% of the supply air from the enclosure at a location proximate the target area at which the persons using the range are shooting;

removing particulate matter from this removed 75% of the air;

removing particulate matter from a volume of out-of-doors are substantially equal to 25% of the supply air in the enclosure;

adding the out-of-doors air equal to 25% of the supply air in the enclosure to the removed 75% of the air;

introducing the mixture of out-of-doors air equal to 25% of the air in the enclosure and removed 75% of the air into the enclosure at a location uprange of persons using the firing range; and, moving the introduction mixture of out-of-doors air equal to 25% of the air in the enclosure and removed 75% of the air past the persons using the firing range in a downstream direction at a substantially uniform velocity of approximately 75 feet per minute (plus or minus 8%) across the width and height of the enclosure.

12. The method of claim 12 wherein the step of removing particulate matter from removed 75% of the air comprises the steps of:

charging the unburned gunpowder and other particulate matter borne by the removed 75% of the air with an electrical potential; and, electrostatically collecting the electrically charged unburned gunpowder and other particulate matter.

* * * * *